United States Patent [19]

McCormick

[11] Patent Number: 4,527,943

[45] Date of Patent: Jul. 9, 1985

[54] LOAD HANDLING METHOD AND APPARATUS

[75] Inventor: Edward J. McCormick, Greene, N.Y.

[73] Assignee: The Raymond Corporation, Greene, N.Y.

[21] Appl. No.: 493,611

[22] Filed: May 11, 1983

[51] Int. Cl.[3] ..... B66F 9/14

[52] U.S. Cl. ..... 414/666; 74/52; 74/96; 414/670

[58] Field of Search ..... 414/281, 282, 283, 662, 414/663, 665, 666, 669, 670, 672, 785, 607, 786; 74/52, 96, 98

[56] References Cited

U.S. PATENT DOCUMENTS

| | | | |
|---|---|---|---|
| 2,945,610 | 7/1960 | Wendt | 414/666 |
| 3,390,798 | 7/1968 | Dixon | 414/666 |
| 3,572,530 | 3/1971 | Ohntrup et al. | 414/666 |
| 3,599,818 | 8/1971 | Stanton | 414/607 |
| 3,659,733 | 5/1972 | Sinclair et al. | 414/670 |
| 3,937,346 | 2/1976 | Van der Laan | 414/666 |
| 3,984,019 | 10/1976 | Brudi et al. | 414/666 X |

*Primary Examiner*—Robert J. Spar
*Assistant Examiner*—Stuart J. Millman
*Attorney, Agent, or Firm*—Richard G. Stephens

[57] ABSTRACT

Method and apparatus for storing and retrieving loads increases usable warehouse storage space by allowing a load having a given length and width to be stored and retrieved from a narrow aisle while requiring less wasted space between adjacent stored loads. As a load is rotated 90° preparatory to translating it into a storage space, the center of rotation is moved first in one direction along the aisle and then in the opposite direction. One corner of the load enters and sweeps across the initially empty storage space, and during a terminal portion of the rotation another corner of the load enters the storage space along a path having little or no component of motion in the aisle direction.

12 Claims, 20 Drawing Figures

LOAD HANDLING METHOD AND APPARATUS

In a variety of lift trucks a load is carried substantially centered on the longitudinal centerline of the truck as the truck travels along a warehouse aisle. When the truck reaches a storage rack space into which the load on the truck is to be deposited, the load is rotated 90°, either to the right or to the left, without turning the truck, and then the load is translated into the storage space and finally lowered slightly to rest in the storage space. Retrieval of a load involves an opposite procedure in which the load is first slightly lifted in the storage rack, translated out into the aisle, and then rotated 90°. With all load rotation occurring within the aisle during either a storage operation or a retrieval operation, loads may be stored in a rack adjacent each other with very little (theoretically zero) clearance between them, but aisle width required to accommodate the rotation tends to depend upon the diagonal dimension of the load. Such an arrangement requires wide aisles and wastes warehouse space.

One known load-handling apparatus decreases the required aisle width by simultaneously translating the center of rotation in one longitudinal or aisle direction as the load is being rotated 90°. A corner of a load being stored sweeps along a curved path which extends into the empty space where the load eventually will be stored. While such a system may be arranged to require less aisle width, it does so at the expense of requiring wasted space between adjacent loads in a storage rack. A tradeoff exists between required aisle width and the required space between adjacent loads. A primary object of the invention is to provide improved load handling method and apparatus which maximizes usable warehouse storage space by allowing, in combination, aisles of such widths, together with a minimum wasted space between adjacent stored loads, such that a larger percentage of a warehouse floor area can be used for load storage. The percentage of the floor space in a warehouse which may be used to store loads may be calculated in a manner shown below to assign storage efficiencies to various load handlers, and an important object of the invention is to provide a load handler having an improved storage efficiency.

A more specific object of the present invention is to provide an improved load-handling method and apparatus which decreases wasted space by providing bi-directional longitudinal shifting of the center of rotation as a load is rotated 90° in either direction.

The storage efficiency of the mentioned prior art load handler can be improved theoretically by use of impractically long links and cranks. An object of the invention is to provide improved load-handling method and apparatus which do not require impractical dimensions of mechanisms.

Another object of the invention is to provide simple, inexpensive and reliable apparatus which will provide such bi-directional shifting of the center of rotation.

Other objects of the invention will in part be obvious and will in part appear hereinafter.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

For a fuller understanding of the nature and objects of the invention reference should be had to the following detailed description taken in connection with the accompanying drawings, in which:

FIGS. 1*a* and 1*b* are isometric diagrams useful in understanding principles of the present invention.

FIG. 1*c* is a graph illustrating variation of the longitudinal position of the center of load rotation versus the angle of load rotation in one embodiment of the present invention, and such variation in a prior art mechanism depicted in FIGS. 3*a* and 3*b*.

FIG. 1*d* is a diagram illustrating simultaneous translation and rotation of a load in accordance with the principles of FIGS. 1*a* and 1*b* of the present invention.

FIG. 2*a* is a top view of a portion of an exemplary load handler according to the invention.

FIG. 2*b* is a cross section elevation view of the exemplary load handler.

FIG. 2*c* is a diagram useful in understanding operation of the exemplary load handler.

FIGS. 3*a* and 3*b* are isometric diagrams useful in understanding principles of a prior art load handler mechanism.

FIG. 3*c* is a diagram illustrating simultaneous translation and rotation with the prior art mechanism of FIGS. 3*a*–3*b*.

FIG. 4 is a geometric diagram useful in understanding the invention.

FIGS. 5,5*a* and 6 are diagrams illustrating modified forms of the invention.

Figure 8A:
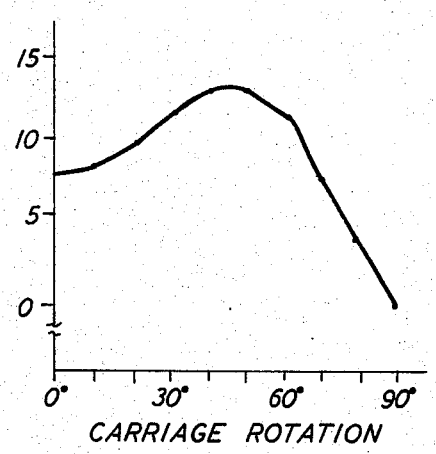
FIG. 8 is a top view diagram illustrating yet another alternative form of load handler mechanism which uses a chain-sprocket connection.
Figures 8, 8B:
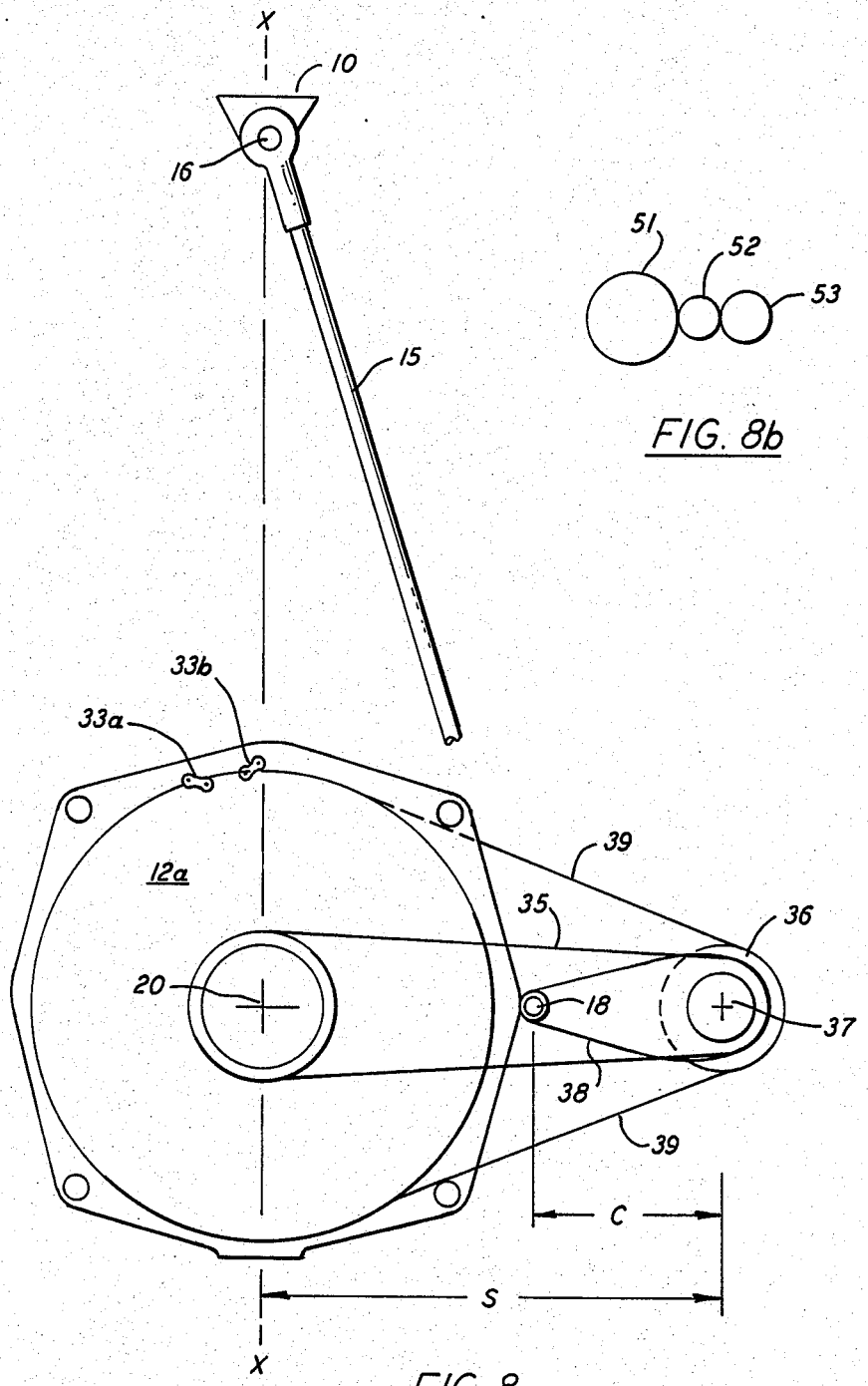

FIG. 8*a* is a graph illustrating typical operation of the mechanism of FIG. 8, and FIG. 8*b* is a diagram illustrating one possible modification in the mechanism of FIG. 8.

Figure 9:
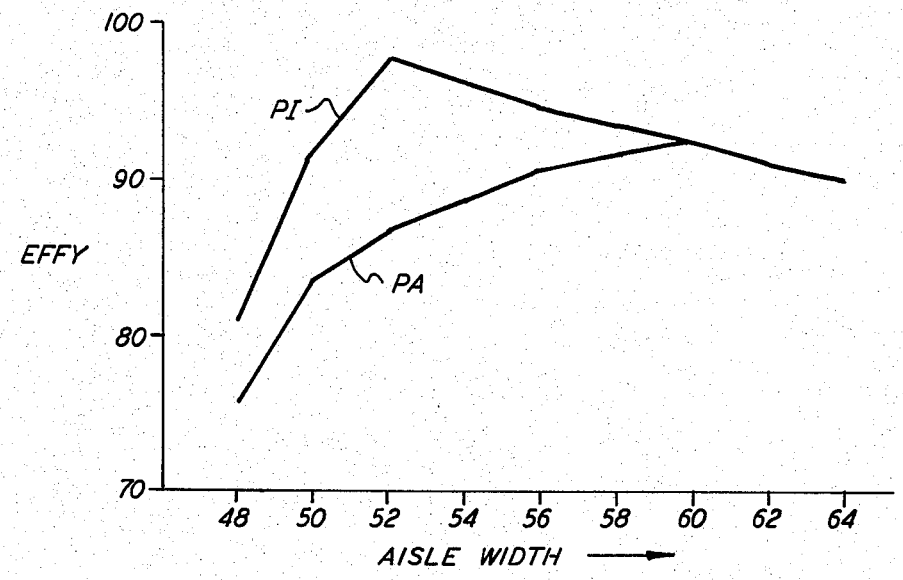

FIG. 9 is a pair of graphs comparing the storage efficiency of a typical embodiment of the invention with that of a typical prior art load handler.

Figure 10:
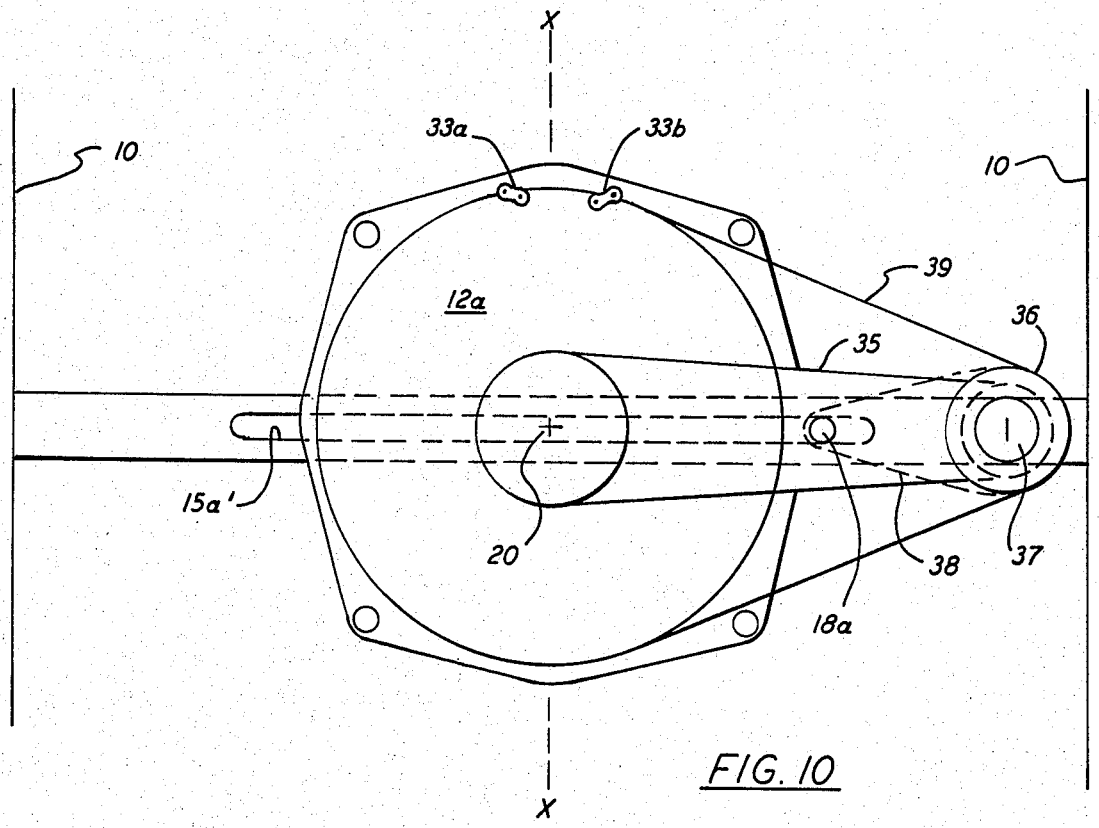

FIG. 10 is a top view of yet another embodiment of the invention.

In the figures, similar parts of different mechanisms are given similar reference characters for sake of clarity and ease of understanding.

Figure 3A:
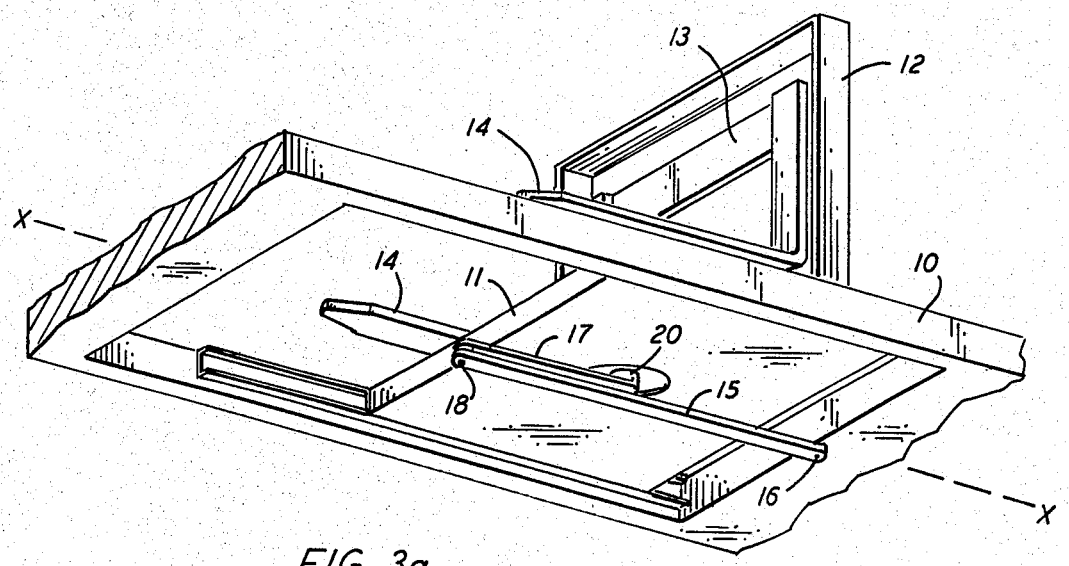
FIG. 3a Prior Art
Figure 3B:
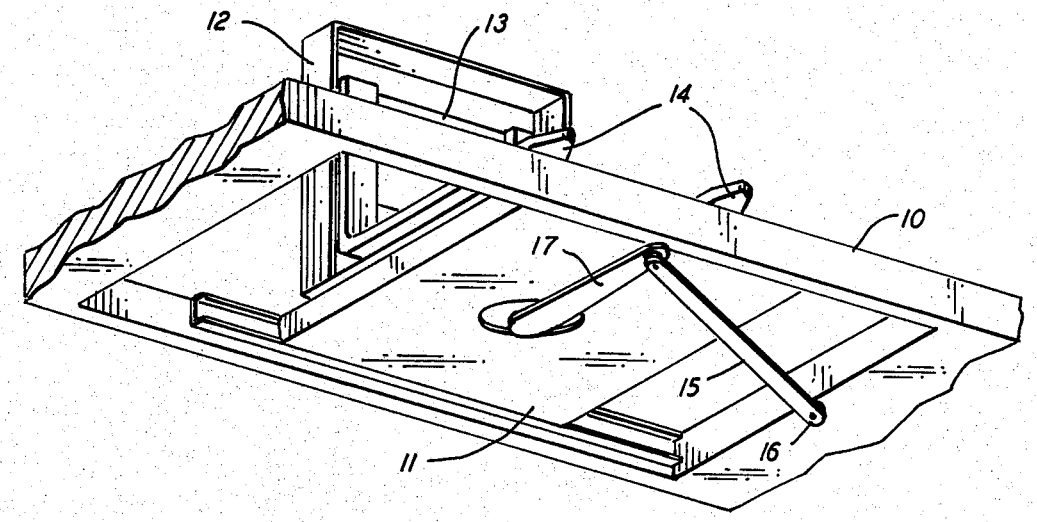
FIG. 3b Prior Art

In FIGS. 3*a* and 3*b* diagrammatically illustrating the principles of the mentioned prior art apparatus, a main carriage 10 which is raised and lowered along a mast by conventional means (not shown) carries a sliding platform 11 which is constrained to slide in the longitudinal or aisle direction indicated by axis centerline x—x. Mounted atop the sliding carriage is a rotating carriage 12 having a conventional scissor mechanism 13 which serves to extend and retract a pair of forks 14, 14. Conventional motive means (not shown) mounted on main carriage 10 serves to rotate carriage 12 about a vertical axis defined by shaft 20, and link means to be described cause that rotation to provide an automatic longitudinal translation of platform 11, shaft 20, carriage 12 and a load (not shown) carried on forks 14, 14. A link 15 is pivotally attached to main carriage 10 at pivot point 16. The other end of link 15 is pivotally attached to a crank 17 at pivot point 18. Crank 17 is rigidly affixed to shaft 20, which is journalled in sliding platform 11 and connected to rotatable carriage 12.

FIG. 3*a* shows the prior load-handling apparatus in the centered condition at which a load is carried along the aisle on forks 14, 14. FIG. 3*b* shows the same apparatus after carriage 12 and the load (not shown) have been rotated 90° in one direction. After carriage 12 has been rotated to the position shown in FIG. 3*b*, it will be understood that scissor mechanism 13 is operated to horizontally extend forks 14, 14 to store or retrieve a load. As link 15 and crank 17 are pivoted away from the centered positions shown in FIG. 3*a*, sliding platform 11 is automatically moved longitudinally, generally leftwardly as viewed in FIGS. 3*a* and 3*b*. Hence the center of rotation of carriage 12, which is defined by shaft 20, simultaneously moves longitudinally generally leftwardly as carriage 12 is rotated, at a rate which varies non-linearly with carriage rotation.

Figure 3C:
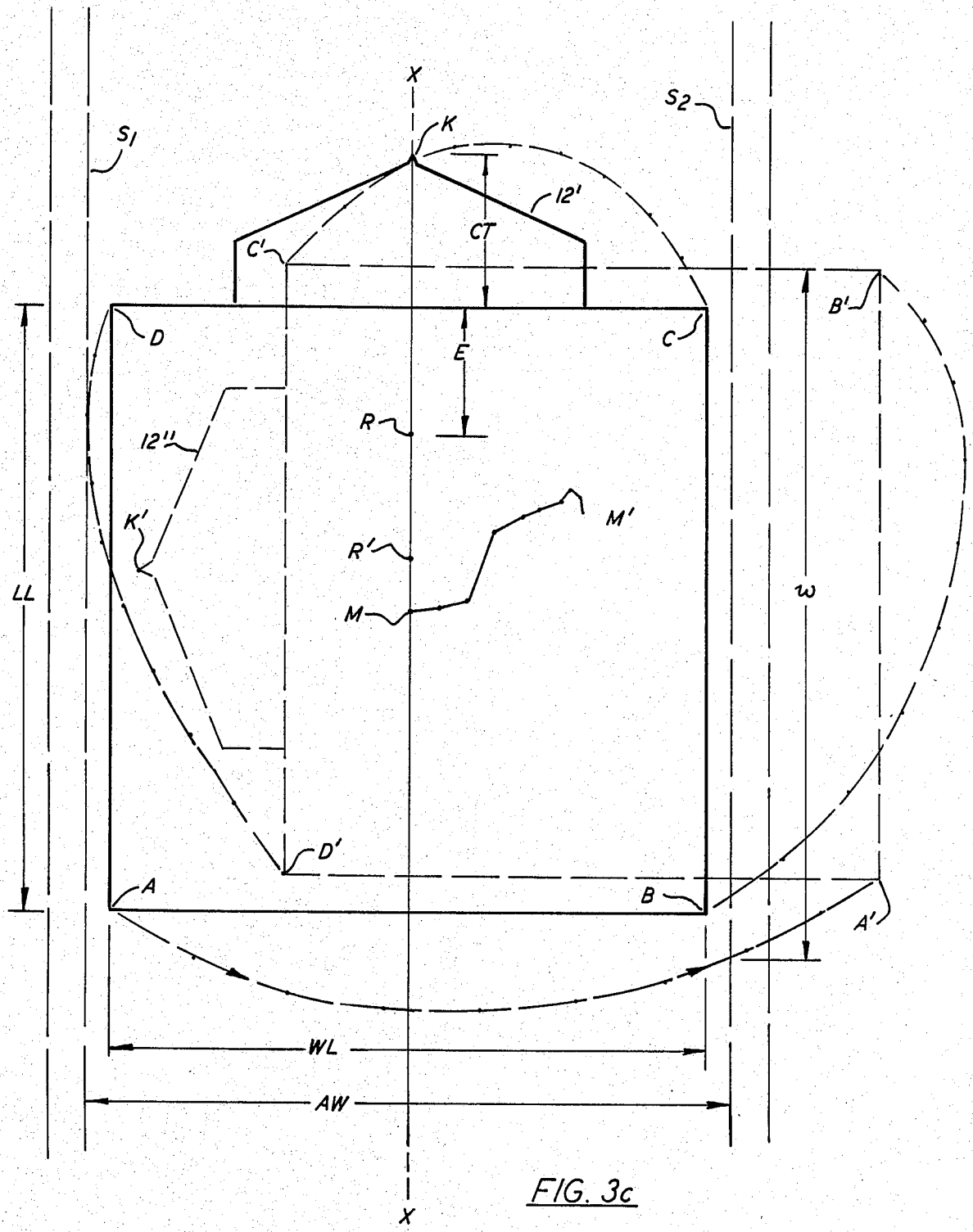

In FIG. 3*c* depicting operation of the prior art mechanism, a rectangular load having corners A, B, C, D is shown in solid lines at an initial load position corresponding to that of FIG. 3*a*, with the load laterally centered on an aisle centerline denoted by axis x—x. The faces of the storage racks defining the sides of the aisle are represented by dashed lines $S_1$, $S_2$. The width WL and length LL of the load are both assumed to be 48 inches (121.92 cm.), and the width AW of the aisle (distance between rack faces $S_1$ and $S_2$) is plotted as 52 inches (132.08 cm.). In the initial position pivots 16 and 18 and the center-of-rotation (shaft 20) are all centered on the aisle centerline (axis x—x), so that rotation of the load in either direction is symmetrical to the aisle. A trapezoid 12′ shown in solid lines and having a rear mid-point K diagrammatically represents space required behind the load to accommodate the back of carriage 12 and portions of the scissor mechanism. In FIG. 3*c* the load is also shown in dashed lines, with the corners at A′, B′, C′ and D′, after the load has been rotated counterclockwise 90° by the prior art mechanism to the condition corresponding to FIG. 3*b*, preparatory to further translating the load rightwardly into a storage rack. The curved paths traversed by the corners of the load during the 90° rotation are shown in dashed lines. The center of rotation defined by shaft 20 initially lies at point R on aisle centerline x—x, and as 90° rotation occurs the center of rotation moves progressively toward point R′. The geometrical center of the load moves from point M along the curved path shown to point M′. The carriage structure depicted moves to the dashed line position shown at 12″, and point K at the rear of the carriage moves to point K′. To minimize aisle width, distance E, the location of the center-of-rotation relative to the load, is shown selected so that corner D of the load will just touch the leftside rack face $S_1$, with zero clearance, as the load is rotated. In practice, distance E is selected, of course, to provide a small clearance between corner D and rack face $S_1$. Since the necessary or desired clearance tends to be somewhat subjective, use of zero clearance will be used to more fairly compare the prior art mechanism with the present invention. If loads to be handled are substantially less wide than that shown, distance E may be increased, so that a point on the carriage structure, such as point K, just barely misses rack face $S_1$ as the load is rotated. In any event, it can be seen that with a given shape load, selection of distance E so that corner D or point K comes very near to the leftside rack face will tend to minimize the required aisle width.

By observing that the path of corner D extends only slightly leftwardly from its original position, one can appreciate that the prior mechanism will allow a given size load to be rotated in a narrower aisle than with earlier arrangements, assuming that corner B can appreciably extend beyond rack face $S_2$ and sweep through empty rack space as the load is rotated, and further assuming that corner A can sweep into empty rack space as the load is rotated. However, for corners B and A to extend appreciably into empty rack space, the width (measured in the x or aisle direction) of the space alotted for the load must be undesirably great. For example, with dashed line $S_2$ representing the face of the rack, the width allotted along the rack for each load must equal or exceed dimension w, to provide a wide enough space to accommodate the swing of corner A. The theoretical minimum required width w which must be allotted for each load will be seen in FIG. 3*c* to substantially equal the difference between the final x coordinate of corner B at B′ and the x coordinate of the point where corner A crosses rack face $S_2$. If the load were somewhat shorter (i.e. dimension LL were less), corner A would cross face $S_2$ nearer to point B′ than where corner A crosses face $S_2$, in which case the theoretical minimum required width w which must be allotted for each load would substantially equal the difference between the x coordinate of B′ and the x coordinate where corner B crosses rack face $S_2$. For some load configurations (width and length combinations) and aisle widths, the x distance between point B′ and where corner B and/or corner A cross face $S_2$ may be less than the width LW of the load, but, of course, the theoretical minimum width which must be allotted for each load must at least equal the width of the load; and, in practice, at least some small clearance must be provided between adjacent loads.

In FIG. 3*c*, where the x coordinate of the final position of corner B (at B′) and the x coordinate of where corner A crosses rack face $S_2$ govern the dimension w, dimension w significantly exceeds the width (48 in. or 121.92 cm.) of the load. With FIG. 3*c* depicting a 48-inch by 48-inch load in an aisle 52 inches (132.08 cm.) wide, the storage space width allotted for each load must exceed 54.147 inches (137.533 cm.), assuming that zero clearance can be allowed between adjacent loads. If the aisle were made narrower, i.e. lines $S_1$ and $S_2$ were moved toward each other in FIG. 3*c*, it will be seen that required storage space width w would have to increase. With the prior art device of FIGS. 3*a*–3*d*, the length of crank 17 theoretically must be less than half the aisle width so as not to extend into rack space, and in practice the length of crank 17 must be appreciably less than half the aisle width. The length of crank 17 must not exceed that of link 15, or else the device cannot turn 90° from the centered condition. FIG. 3*c* assumes that the length (L) of the link is 28 inches (71.12 cm.) and that (C) of the crank is 23 inches (58.42 cm.) which provides substantially optimum operation of the prior art device. It is theoretically possible to slightly improve the operation of the prior art device by assuming the use of greater link and crank lengths for that mechanism, but because the crank length cannot possibly exceed half the aisle width, the storage efficiency of the prior art device is inherently limited to a significantly lower value than that of the present invention; indeed, even if the crank and link lengths of the prior art device were not so constrained, it still provides a storage efficiency inferior to that of the present invention.

By way of contrast to the present invention, it may be noted that crank 17 of the prior art apparatus rotates at the same angular rate as the carriage 12, and that the center of rotation (shaft 20) moves in only one direction along the x axis as carriage 12 rotates from 0° to 90°. The relationship between translation of the center of rotation and carriage rotation itself approximates a portion of a cosine function, and importantly, a portion lying solely within one quadrant of the approximate cosine function. The variation in the longitudinal position of the center rotation (shaft 20) relative to the pivot point 16 on the main carriage can be expressed as:

$$x = \sqrt{L^2 - C^2\sin^2\theta} - C\cos\theta \tag{1}$$

where L and C are the lengths of link 15 and crank 17, respectively, and $\theta$ is the angle of shaft 20 and carriage 12 measured from the aisle-centered position. The manner in which the longitudinal position of the center of rotation varies with load rotation in the prior art mechanism is plotted at PA in FIG. 1*c*, with link and crank lengths of 28 and 23 inches, respectively.

A theoretical storage efficiency factor for a load handler may be computed by comparing the floor space or area which can be filled with loads handled by the load handler, with the total floor space or area required. If a length WR is required along each rack face in order to swing a load 90° into or out of a rack on either side of an aisle of width AW, the total floor area required to service the two load positions is WR (2LL+AW), and the area occupied by the two loads is 2LL×LW, so that the percentage of used floor area available for storage is given by:

$$\frac{2LL \times LW}{WR(2LL + AW)} \times 100$$

With a given load handler, a decrease in aisle width results in an increase in dimension WR, so that the storage efficiency cannot exceed some maximum value. A theoretical "perfect" load handler accommodating loads having a width equaling the aisle width, and requiring no more length WR along each rack face than the load width could, when it handled square loads, fill two-thirds, or 66.6% of the floor space needed to use it. Practical load handlers, which require some wasted space in which to operate, can be evaluated in accordance with a storage efficiency:

$$EFF = \frac{3LL \times LW}{WR(2LL + AW)} \times 100$$

which approaches 100%, to the extent which a load handler wastes no floor space. Utilizing such a criterion, the prior art device depicted in FIGS. 3*a*–3*d* achieves an efficiency EFF of 86.25%, while the device of the present invention described in connection with FIGS. 1*a*–1*d* achieves an efficiency EFF of 97.3%.

Figure 1A:
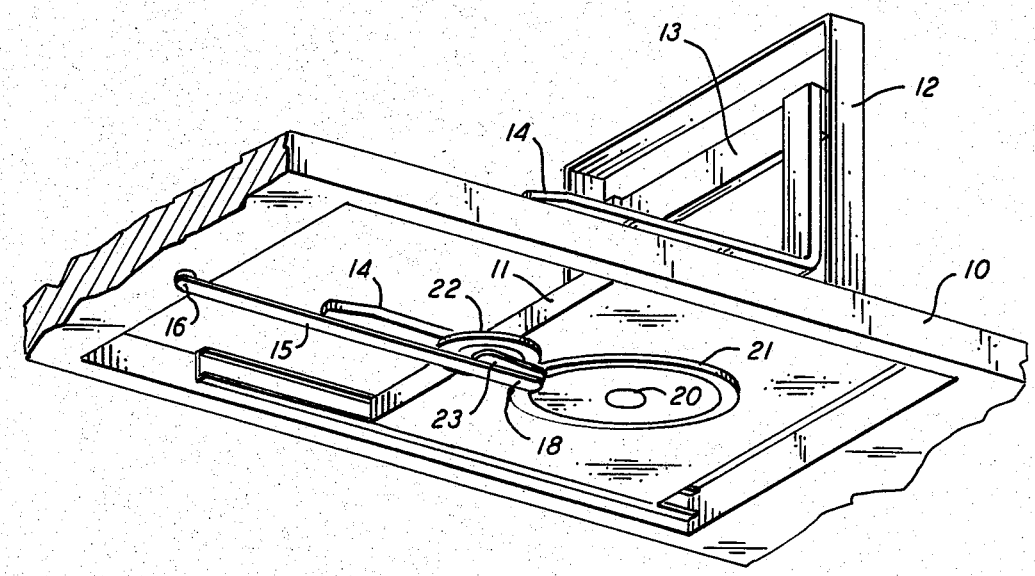
Figure 1B:
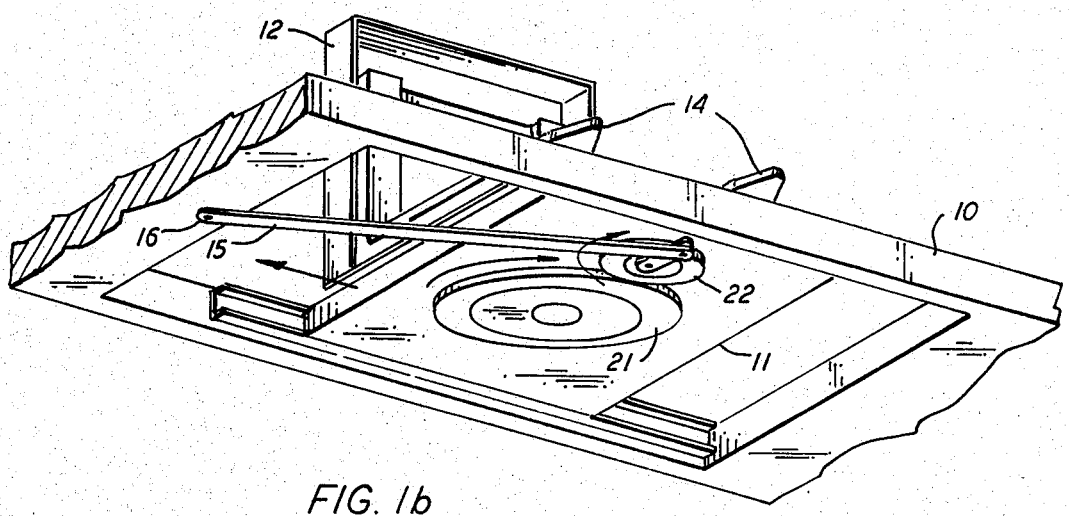

In the form of the invention diagrammatically depicted in FIGS. 1*a* and 1*b*, the carriage 12 is also shown rotatably mounted on a shaft 20 journalled in sliding platform 11. A large gear 21 is mounted concentrically with shaft 20, but effectively fixed to the underside of platform 11 so as not to rotate. A small gear 22 meshes with larger gear 21 and moves around 90° of the periphery of gear 21 as carriage 12 is rotated 90°. The manner in which carriage rotation causes gear 22 to move around fixed gear 21, and the manner in which gear 22 is held meshed with gear 21, will become clear below. A crank 23 which is rigidly connected to gear 22 is pivotally connected at 18 to one end of link 15, and the other end of link 15 is pivotally mounted at 16 to main carriage 10. As carriage 12 is rotated, shaft 20, the sliding platform 11 and carriage 12 are simultaneously translated in the x direction, initially generally leftwardly in FIGS. 1*a* and 1*b*, but, importantly, with a different relationship between carriage rotation and longitudinal translation than that which pertains to the prior art mechanism.

The manner in which longitudinal positon of the center of rotation varies with carriage rotation for the system of FIGS. 1*a* and 1*b* may be expressed as:

$$x = \sqrt{L^2 - (C\sin(R\theta + \theta) - S\sin\theta)^2} - C\cos(R\theta + \theta) + S\cos\theta \tag{2}$$

where L and C are the lengths of link 15 and crank 23, respectively; R=radius of large gear 21 divided by the radius of small gear 22, S=sum of the radii of the two gears, and x is the instantaneous distance of the center of rotation from the pivot point 16 on the main carriage.

Figure 1C:
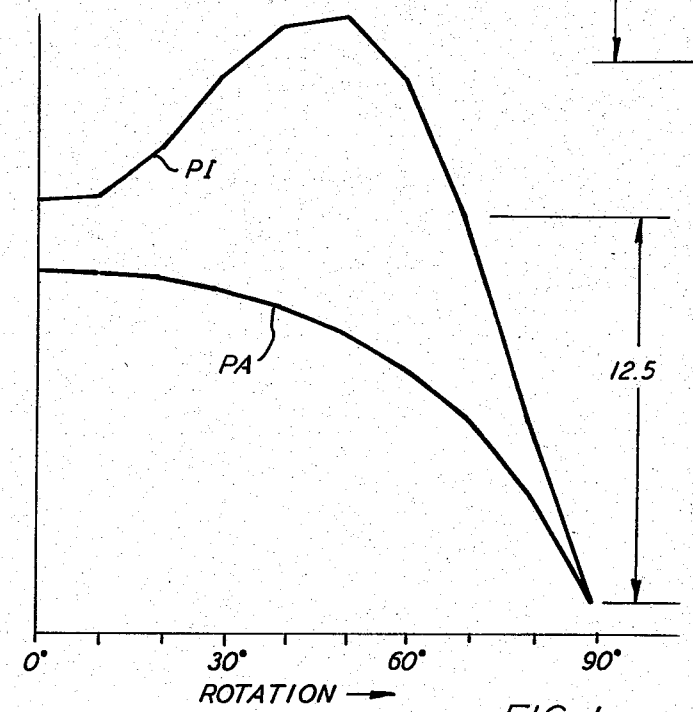

FIG. 1*c* shows at PI how the longitudinal position of the center-of-rotation varies for the system of FIGS. 1*a* and 1*b* with the following relative dimensions:

L=16

C=5.5

Gear radii: 6,3.

The ordinates in FIG. 1*c* are the distances of the center of rotation from an arbitrary point on the aisle centerline. It is important to note that the center of rotation of the invention initially begins to move in one direction along the x axis, away from the pivot point on the main carriage, but then reverses direction and moves toward the pivot point on the main carriage. The steep slope of the rightmost portion of the curve PI, in the range of say 60°–90°, is particularly important, for reasons which will become clear below.

Figure 1D:
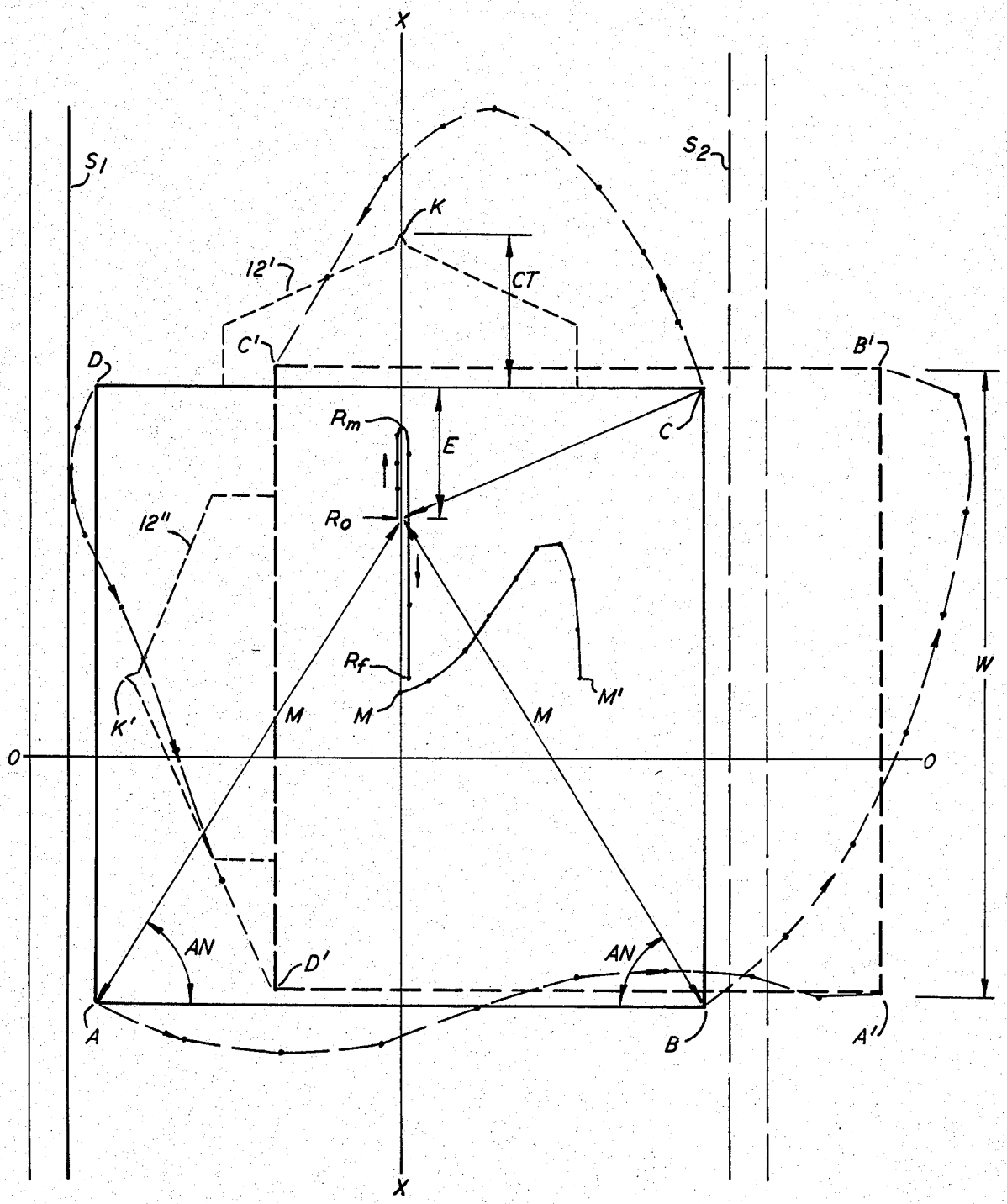

FIG. 1*d* graphically depicts the paths of the corners as a square load is rotated 90° counterclockwise in accordance with the present invention, from the aisle-centered position shown in solid lines to the position shown in dashed lines, preparatory to further translating the load rightwardly to store it. As in FIG. 3*c*, x—x represents the aisle centerline, $S_1$ and $S_2$ represent the sides of the aisle, 12' represents the rear of the carriage structure, and distance E is selected so that corner D will just touch the leftside rack face $S_1$. As the load is rotated counterclockwise, corners A, B, C and D move along the curved paths shown to points A', B', C' and D', and the carriage rear structure swings to the dashed-line position shown at 12''. It may be noted that the path of corner D extends only slightly leftwardly from its original position, so that much like the prior art device, aisle space required to rotate the load is modest. However, as corner A completes the final third or quarter of its travel from point A to point A', its path contains very little and sometimes zero x component. It may be noted that the x distances from point B', the final position of corner B, to the points where corners A and B cross the rack face $S_2$ are both less than the width (48 in.) of the load. With such paths provided for corners A and B, the width of a rack opening, or the dimension (measured along the aisle) required to store and retrieve the load, need not exceed the width dimension of the load, again assuming zero clearance. With the same load and aisle dimensions assumed as in FIG. 3*c*, the required storage space width in FIG. 1*d* is reduced to the load width, or 48 inches, as compared to 54.147 inches in FIG. 3*c* for the prior art. By tailoring crank and link lengths, the gear ratio and the gear diameters for use with loads having a given length and width in an aisle of a given width, it is theoretically possible by means of the invention to make the "zero clearance" storage space width not exceed the width of a typical load, so that essentially no space need be wasted between adjacent loads. In many applications of the invention the dimensions will be tailored so that the space along the rack allotted for each load exceeds the width of the load, but in an amount such that the decreased aisle width results in a maximum storage efficiency.

In practice some appreciable space will be left between adjacent stored loads, of course, in case loads are misaligned, tilted or turned on their respective pallets, for example, and if a vehicle is intended to handle loads having several different widths and/or lengths, the crank and link lengths ordinarily will be given compromise values which do not provide the theoretical minimum require storage space width for any shape load, but an acceptably small required storage space width for all such loads. It will become readily apparent to those skilled in the art that the lengths of link 15 and crank 23 may be made adjustable, if desired, so that ideal storage space widths can be provided for different load shapes quite rapidly.

With the load initially centered in the aisle, shaft 20, the centers of gears 21 and 22 and pivots 16 and 18 all initially lie on the aisle centerline x—x. The initial position of shaft 20, the center of rotation, is shown at $R_o$ in FIG. 1*d*. As the load is rotated counterclockwise, the center of rotation first moves upwardly (in FIG. 1*d*) along the x axis to point $R_m$, and then in the opposite direction, reaching a final position at point $R_f$ as carriage rotation reaches 90°. In FIG. 1*d* the path of the center of rotation is plotted slightly displaced from the x axis to provide a clear showing of the path of travel between point $R_o$ and point $R_f$. As the load is swung counterclockwise, the geometrical center of the load follows the curved path extending from point M to point M'. The dots along the various curves denote positions reached at successive 10° increments of rotation of the load.

Figure 4:
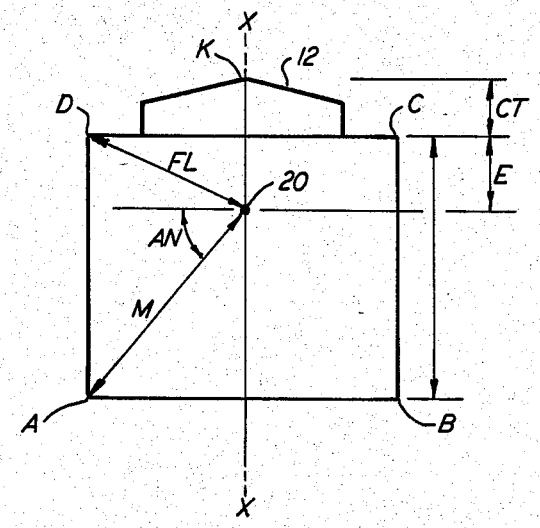

The x coordinate of corner A relative to fixed pivot point 16 may be expressed as:

$$x_A = x + M \sin(\theta - AN) \quad (3)$$

where x is the distance given by equation (2) above, M is the radial distance between corner A and the axis (shaft 20) about which load rotation occurs, and AN is the angle between that axis and corner A, as shown in FIG. 4. Angles are considered negative counterclockwise. In FIG. 4 distance E is the longitudinal distance between the axis at shaft 20 and the rear edge of the load (defined by corners C and D) with the carriage and load centered in the aisle. To tailor the invention for a load of given width (WL) and given length (LL), operating in an aisle of given width, with a given distance CT required to accommodate the scissors reach mechanism, one may first determine distance E. Distance E ordinarily will be selected either (1) so that the distance (CT+E) is slightly less than one-half the aisle width, which will result in the rearmost point K of carriage 12 lying close to but missing either storage rack face by a desired small clearance after the carriage has been rotated 90° in either direction, or (2) so that radial distance FL will cause corners D and C to barely miss rack faces $S_1$ and $S_2$ as the load is rotated 90° in one direction or the other from the centered condition. In FIGS. 3*d* and 1*d* the distance E is shown as 10.0 in. (25.4 cm.) so that corner D will just touch rack face $S_1$ as the carriage is rotated 90° in the CCW direction. Having determined distance E and then knowing radial distance M and angle AN, one then determines how the quantity M sin ($\theta$−AN) varies as carriage angle varies between say 70° and 90°. Then if longitudinal translation of the center-of-rotation during the same range of carriage rotation is made to be approximately equal and opposite to the variation of M sin ($\theta$−AN), the quantity $x_A$ will experience little or no change during that angular range, and corner A will enter the rack space with little or no change in the x position, in the manner depicted in FIG. 1*d*. In the apparatus whose operation is depicted in FIG. 1*c* and FIG. 1*d*, the angle AN has a value of 57.72°, and radial distance M has a length of 44.94 length units. As carriage rotation $\theta$ varies from −70° to −90°, the quantity M sin ($\theta$−AN) varies in the positive direction, from a value of −35.55 to a value of −24.00. That positive change would tend to cause average upward movement of corner A at roughly 0.578 length units per degree of rotation; however, as indicated by the steep tail-end of the displacement curve for the invention plotted in FIG. 1*c*, the center-of-rotation is simultaneously moved downward in FIG. 1*c* at approximately the same average rate of −11.55/20 or 0.577 length units per degree, providing a net change in the x position of corner A which is very small during that angular range of carriage rotation.

While FIG. 1*d* has been described in terms of counterclockwise carriage rotation preparatory to storing a load, it will be apparent at this point that the corners of the load and the midpoint of the load, will travel in opposite directions along mirror images of the paths shown as the carriage is rotated 90° clockwise while retrieving a load. And due to the symmetry about the x—x axis of the mechanism depicted in FIGS. 1*a* and 1*b*, it will be apparent at this point that identical mirror-image operation will occur as the carriage is rotated 90° clockwise from an aisle-centered position while storing a load on the opposite side of the aisle, or rotated 90° counterclockwise to the aisle-centered position while retrieving a load from that side of the aisle.

While a conventional scissors-type load extension mechanism has been diagrammatically depicted in FIGS. 1*a* and 1*b* for sake of simplicity, and while a reach mechanism certainly can be used to translate the load into or out of a storage rack after the carriage 12 has been rotated 90° in either direction from the aisle-centered position, it should be noted that a variety of other known forms of load extension mechanism may be used. Further, while forks have been illustrated as the ultimate load-carrying structure, it will be apparent that other known forms of load carrier or load manipulator can be substituted without departing from the invention.

While a 2:1 gear ratio has been described for gears 21 and 22, and while that ratio has proven satisfactory in practice of the invention, other gear ratios, such as 4:1 may be employed in various applications of the invention, as will be seen below. As well as the gear ratio and the gear diameters, the lengths of the crank and the link, and the distance E (FIG. 4) may be varied in various applications of the invention.

Figure 2C:
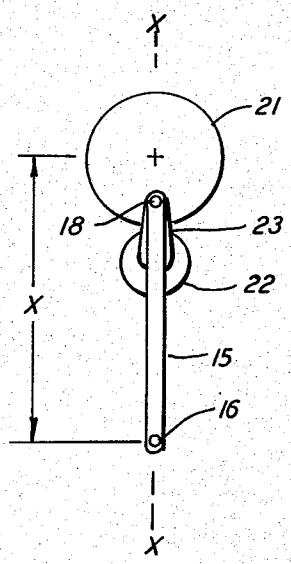
Figure 2A:
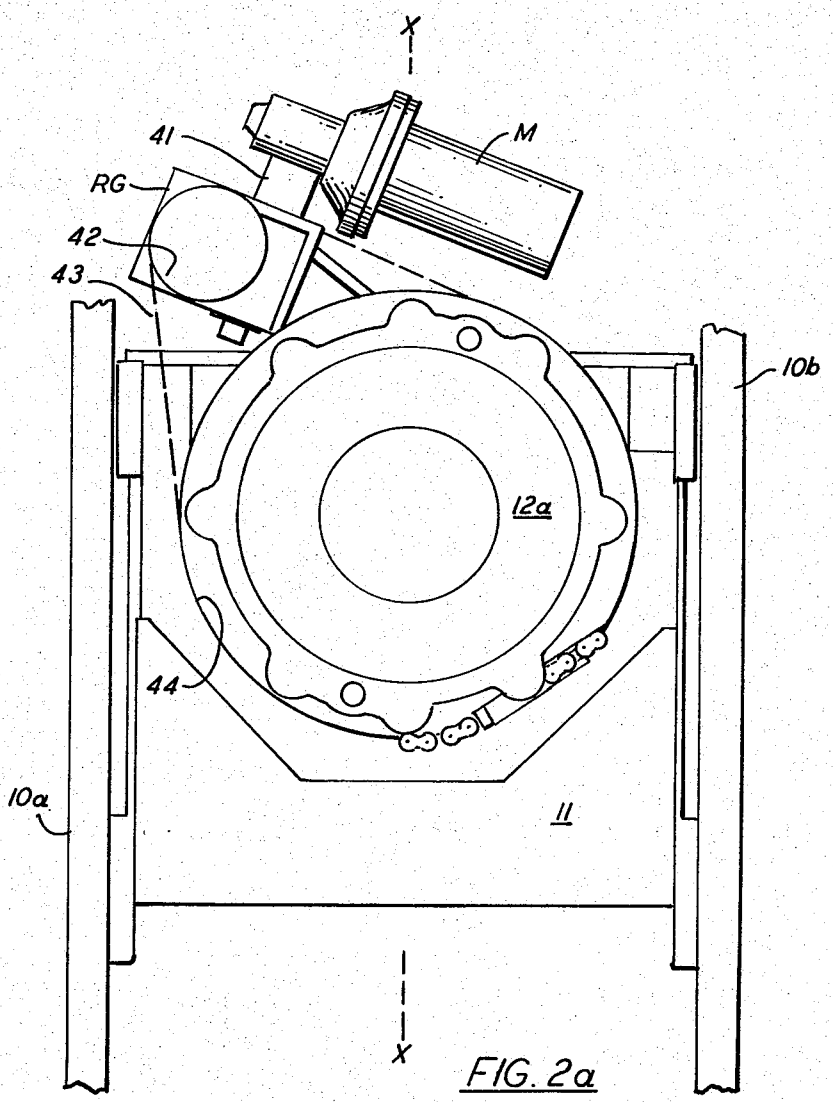

In FIG. 2*a* members 10*a* and 10*b* are longitudinally and horizontally extending side members of main carriage 10, the carriage which is elevatable and lowerable, but which does not rotate about a vertical axis. Sliding platform 11 is carried in ways in members 10*a*, 10*b*, so as to roll or slide back and forth in the x direction, and rotatable assembly 12*a* is journalled in platform 11. Rotatable carriage 12, with the reach mechanism 13, neither of which are shown in FIG. 2*a*, are bolted atop member 12*a*. Motor M and reduction gearing RG are supported from platform 11 by a bracket 41, and motor M drives sprocket 42 via the reduction gearing. Rotatable assembly 12*a* is provided with a drive plate 44 having a periphery around which a chain 43 driven by sprocket 42 is passed, with the ends of chain 43 fixed to drive plate 44. Chain 43 is partially indicated by dashed lines. Thus rotation of motor M and sprocket 42 will be seen to rotate assembly 12*a*, and the carriage and and reach mechanism carried atop assembly 12*a*.

Figure 2B:
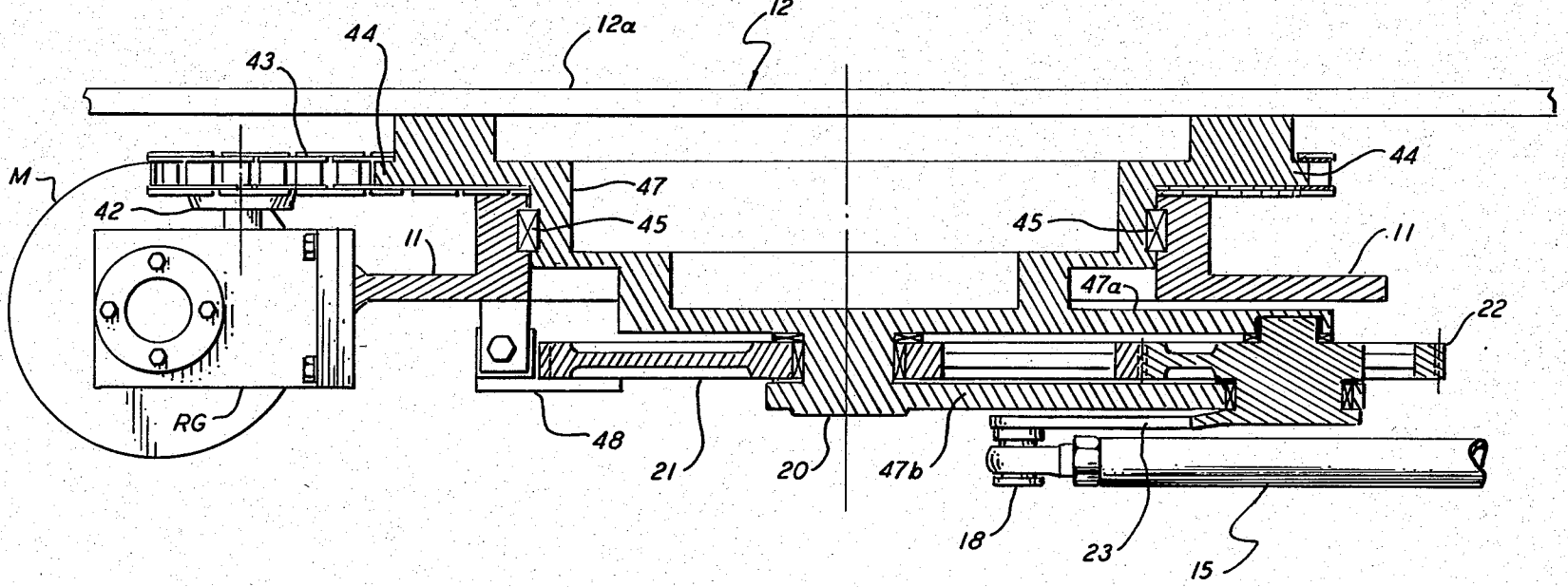

In FIG. 2*b* the upper portion of the rotatable assembly is shown at 12*a* and its drive plate at 44. A rotatable hub 47 depending from drive plate 44 and having a shaft portion 20 is journalled in platform 11 by means of bearing 45. Larger gear 21 is concentrically journalled on shaft 20 but fastened to platform 11 by means of bracket 48, so that gear 21 cannot rotate relative to platform 11. Small gear 22 is rotatably journalled in arms 47*a*,47*b* extending from rotatable shaft 20 to mesh with large fixed gear 21, and hence to be swung about the periphery of gear 21 and rotated as the carriage is rotated. Crank arm 23 is rigidly affixed to small gear 22. With a 2:1 gear ratio with the arrangement shown, a given angular rotation of carriage 12 will cause gear 22 and crank 23 to rotate through an angle three times the given angle. The length of crank 23 is shown as exceeding the radius of small gear 22. The outer end of crank 23 is pivotally attached at 18 to one end of link 15, the other end of which is not shown in FIG. 2*b*, but attached to the main carriage 10 on its centerline as previously described.

In order to provide the translation versus rotation characteristic plotted for the invention in FIG. 1*c*, the initial or centered position of the mechanism of FIGS. 1*a*,2*a* and 2*b* is arranged as diagrammatically shown in FIG. 2*c*, with gear 22 on the same side of gear 21 as the fixed pivot point 16 on the main carriage, and with crank 23 pointing away from fixed pivot point 16, whereby the initial distance given by equation (2) for a carriage rotation of zero degrees equals the quantity (L−C+S).

With the length of crank 23 exceeding the radius of gear 22, the path of pivot point 18 relative to platform 11 as the carriage is rotated constitutes a prolate epitrochoid. Hence gears 21 and 22 constitute means for moving a pivot point along a prolate epitrochoidal path relative to translatable platform 11.

Gear 22 travels 90° in either direction around the periphery of gear 21, and hence only a segment slightly exceeding 180° of gear 21 need be provided. It will be apparent that the invention could be constructed, if desired, for carriage rotation limited to one quadrant for use in a vehicle intended to service storage space on only one vehicle side, though it is contemplated that in most applications carriage rotation through an 180° arc will be provided.

While the invention thus far has been illustrated in connection with a system where the motive means which rotates the carriage also causes longitudinal translation of the load carriage rotational axis, it is within the scope of the invention to provide similar translation using a separate motive means to move the sliding platform relative to the main carriage in accordance with the desired non-linear relationship.

Figure 5A:
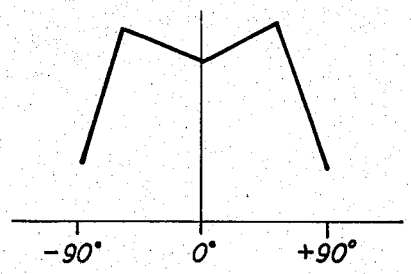
Figure 5:
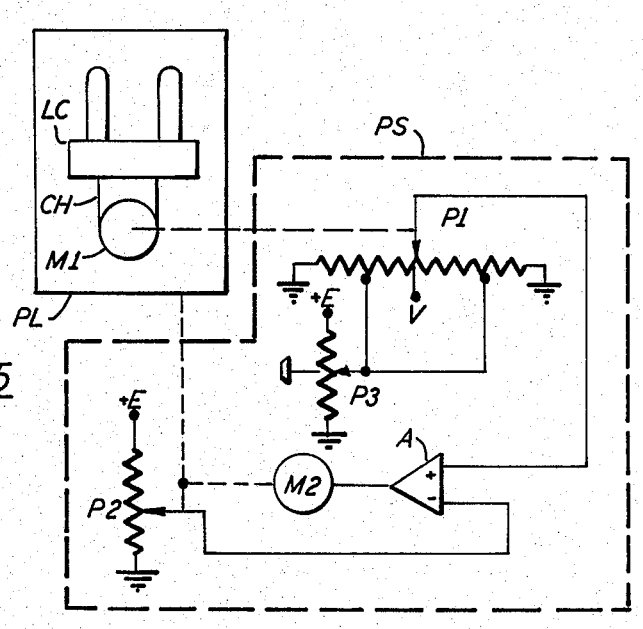

As schematically illustrated in FIG. 5, motor M1 is arranged to rotate load carriage LC, as by means of a chain CH, or example, and simultaneously to position the wiper arm of potentiometer P1. Potentiometer P1 is shown provided with a non-linear voltage versus shaft rotation characteristic by means of taps spaced along its resistance element, one simple such characteristic being shown in FIG. 5*a*. Provision of arbitrary non-linear functions is well-known in the analog computer art, and potentiometer P1 readily could be excited, if desired, so as to provide a characteristic approximating as closely as desired, the characteristic for the invention shown at PI in FIG. 1*c*, for example. The voltage on the wiper arm of potentiometer P1 is applied to a position servomechanism shown within dashed lines PS. The servomechanism longitudinally translates platform PL, on which the load carriage is journalled, relative to the main carriage. The position servomechanism can take any of a variety of forms, and none of its details form part of the present invention. Summing amplifier A receives the voltage from potentiometer P1 and a feedback voltage from linear function potentiometer P2, amplifies the difference between those voltages, and drive motor M2 until the two voltages are equal. The two excitation taps on potentiometer P1 are shown supplied with excitation voltage from a further potentiometer P3. Potentiometer P3 may be adjusted to raise or lower the peaks of the function shown plotted in FIG. 5*a* (and simultaneously vary the slopes of the straight-line portions of the function, of course) to provide different load paths for different sizes and shapes of loads.

Figure 6:
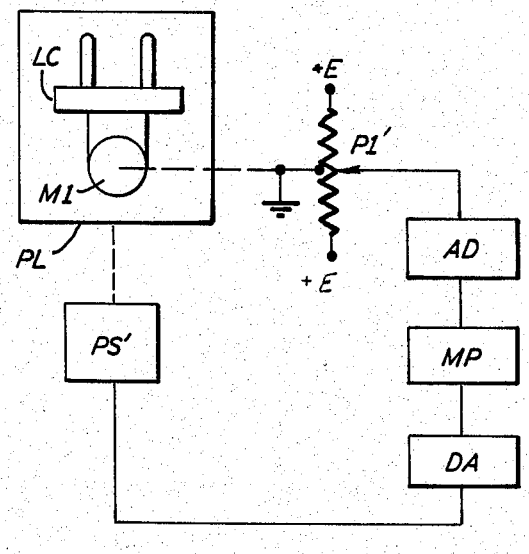

In FIG. 6 rotation of load carriage LC by motor M1 moves the wiper arm of a linear function rotary potentiometer P1′. The voltage from potentiometer P1′ is converted to digital signals by a conventional analog to digital converter AD. The digital signals from converter AD are applied to a microprocessor MP which provides a digital output signal in accordance with the desired non-linear function, such as the simple function shown plotted in FIG. 5*a*, for example, or a much more complex function, if desired. The digital output signal from the microprocessor is then converted to an analog electrical signal by conventional digital to analog converter DA, and the analog signal operates position servomechanism PS′ to longitudinally shift platform PL and load carriage LC relative to the main carriage as load carriage rotation occurs.

Figure 7:
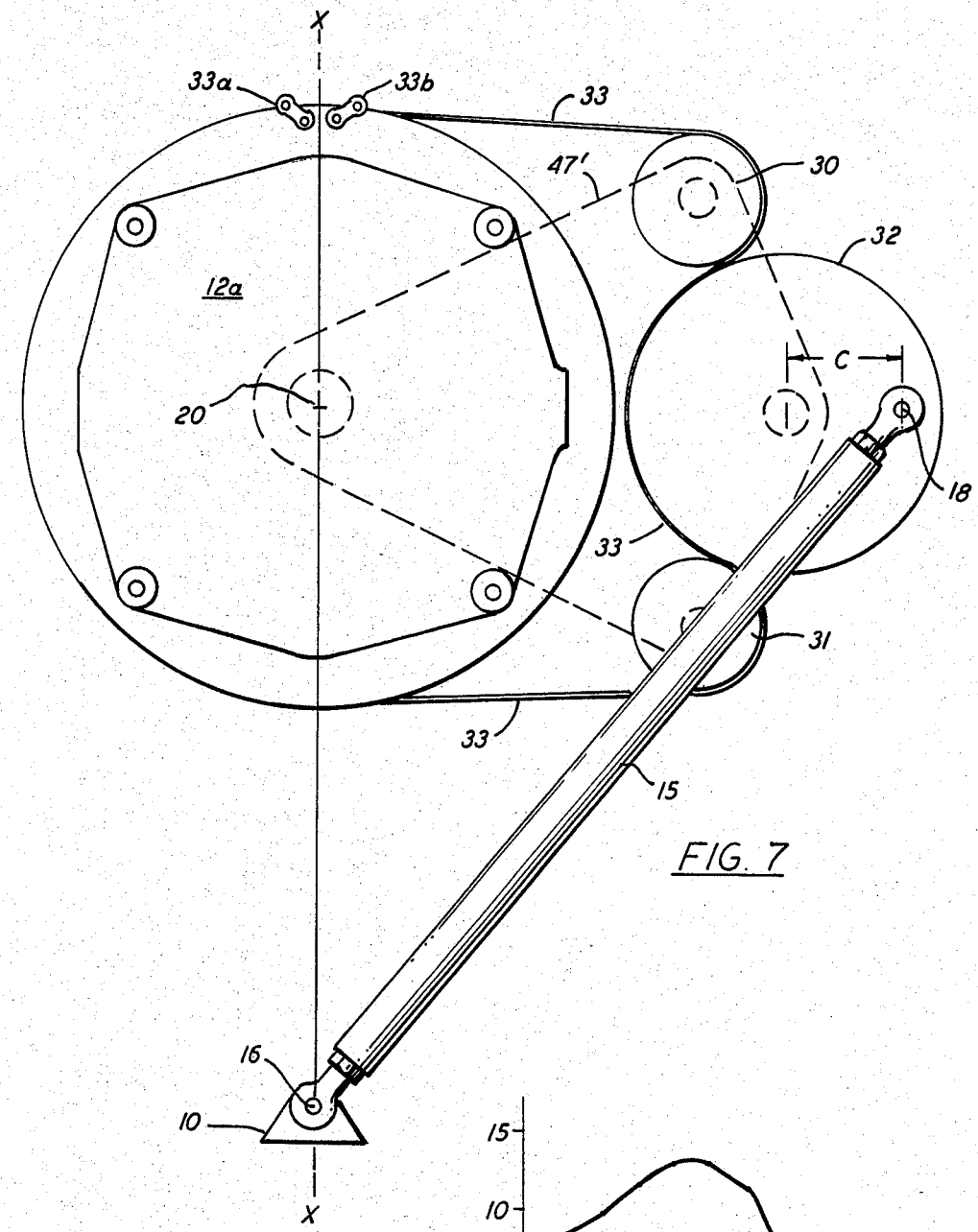
FIG. 7 is a top view of one alternative form of load handler mechanism which uses a chain-sprocket arrangement in lieu of gears to achieve the desired motions.

It is within the scope of the invention to move the end of a link along a prolate epitrochoidal path using means other than gears, and FIG. 7 diagrammatically illustrates one such arrangement. A pair of arms, only one of which is shown at 47, similar to principle to arms 47*a*,47*b* of FIG. 2*b* are pivotally mounted to swing about shaft 20, about which shaft load carriage platform 12*a* rotates, and which shaft is journalled in the longitudinally-movable platform. In FIG. 7 the upper one of the pair of arms is shown at 47′, and shown supporting a pair of idler sprockets 30,31 and a crank sprocket 32. A chain 33 having its ends secured to the load carriage at 33*a*,33*b* encircles the pair of idler sprockets, and is engaged by crank sprocket 32. Crank sprocket 32 has one-half the diameter of the circular portion of the load carriage platform about which chain 33 is wrapped. In FIG. 7, the mechanism is shown with the load carriage having been turned 90° counterclockwise from the centered or aisle-travel position. If the load carriage is rotated 90° clockwise from the position shown in FIG. 7, crank sprocket 32 will be rotated 270° clockwise. One end of link 15 is attached at pivot point 18 to crank sprocket 32, at a crank length distance C from the axis of crank sprocket 32, and the other end of link 15 is affixed at 16 to the main carriage 10, on the x—x axis. As such rotation occurs, pivot point 18 traverses prolate epitrochoidal path identical to that provided in the embodiment of FIGS. 1*a*–1*c*, 2*a*,2*b*, and hence the same load carriage translation vs. rotation characteristic is provided.

In FIG. 8 arm 35 extends radially from shaft 20 and rotates with the load carriage platform 12*a* about the axis of shaft 20. The outer end of arm 35 carries a sprocket 36 on a shaft 37, and crank 38 is keyed to shaft 37. A chain 39 having its ends secured to the load carriage at 33*a*,33*b* encircles sprocket 36. One end of link 15 is pivotally attached at 16 to the main carriage 10 on the x—x axis, and the other end of link 15 is pivotally connected to the outer end of crank 38 at 18, the latter connection being omitted from FIG. 8 for sake of clarity. It may be noted that pivot point 16 is attached on main carriage 10 on the opposite side of the center of rotation along the x—x axis. Being able to freely locate pivot point 16 on the main carriage at alternate points advantageously allows one to accommodate other mechanisms. The diameter of the load carriage platform 12*a* about which chain 39 wraps is four times the diameter of sprocket 36. The mechanism is shown in FIG. 8 with the load carriage having been rotated 90° counterclockwise from the centered or aisle-travel position. If the load carriage is rotated 90° clockwise from the position shown in FIG. 8, crank 38 will rotate counterclockwise 270° about the axis of shaft 37 and sprocket 36. Thus when arm 35 extends vertically (in FIG. 8) in the centered condition, crank 38 again will be aligned with arms 35, making it apparent that the mechanism is symmetrical, i.e. that 90° carriage rotation can occur in either direction from the centered condition. In the centered condition the distance of the center of rotation (shaft 20) from the pivot point 16 of link 15 on the main carriage is equal to the length L of link 15, plus the length C of crank 38, less the length S of arm 35. The manner in which translation of the center of rotation varies with rotation of the load carriage in either direction from the centered position using a typical mechanism according to FIG. 8 is graphically illustrated in FIG. 8*a*, wherein values L, C and S were assumed as follows:

L=31.62 in.
C=4.25 in.
S=12.88 in.

As was explained in connection with curve PI in FIG. 1*c*, the variation of the center of rotation during the terminal portion of the rotation is particularly important.

Operation equivalent to that of mechanism of FIG. 8 may be obtained by substituting a gear train of the type shown in FIG. 8*b*, wherein gear 51 has four times the diameter of gear 53. Gear 51 may be fixed (non-rotatable) in the manner of gear 21 in FIG. 1*a*, and gears 52 and 53 are swung about gear 51 as the load carriage is rotated, with a crank rotating at the speed of gear 53, and the crank connected to a link, the other end of which is fixed to the main carriage.

FIG. 9 illustrates how the storage efficiencies of the specifically described embodiments of the present invention (at PI), and of the prior art mechanism (at PA), vary for a 48 by 48 in. (121.92 by 121.92 cm.) load as aisle width is changed. The storage efficiency of the present invention surpasses that of the prior art mechanism over a substantial range of aisle widths. The storage efficiencies become the same, of course, when aisle width equals or exceeds a value such that basic load width is the minimum rack width required for a load. Curves PA and PI in FIG. 9 are theoretical curves based on an assumption of zero clearance.

FIG. 10 illustrates a modified form of the invention which largely corresponds to FIG. 8, except that no link 15 is utilized, and its function is replaced by a slot 15*a*′ which extends laterally partway across a plate 10*e* fixedly attached to main carriage 10. Pin 18*a* rides in slot 15*a*′ as the carriage is rotated, providing the same longitudinal motion of the center of rotation as would be provided by an infinitely long link 15. The center of rotation 20 shaft is journalled in sliding platform 11, which is omitted from FIG. 10 for sake of clarity and ease of understanding. Slot 15*a*′ may be provided with a curvature to provide the function of a link of any desired length.

Use of the position of corner B at 90° carriage rotation is not rigorous, and the maximum x coordinate where edge BC of the load crosses rack face $S_2$ should be used for greater accuracy in calculation of the minimum width required.

By having the center of rotation move in two opposite directions as the load is rotated 90° in one direction, the length of the carriage 10 holding the sliding platform, and hence the length of the truck, can be minimized while still allowing a corner of the load to enter the rack with very little x component of motion. This is another object of the invention.

It will thus be seen that the objects set forth above, among those made apparent from the preceding description, are efficiently attained. Since certain changes may be made in carrying out the above method and in the constructions set forth without departing from the scope of the invention, it is intended that all matter contained in the above description or shown in the accompanying drawings shall be interpreted as illustrative and not in a liming sense.

The embodiments of the invention in which an exclusive property or privilege is claimed are defined as follows.

I claim:

1. Load handling apparatus, comprising, in combination: a main carriage elevatable and lowerable along a mast; a platform mounted on said main carriage for reciprocating movement relative to said main carriage along a first substantially horizontal axis; a load carriage mounted on said platform for rotation about a substantially vertical axis, said load carriage including a load support means and means for extending and retracting said load support means parallel to a second substantially horizontal axis; motive means for rotating said load carriage in a first direction of rotation between a first angular position in which said second substantially horizontal axis substantially coincides with said first substantially horizontal axis, and a second angular position substantially 90 degrees from said first angular position; and means, synchronized with said means for rotating, for translating said platform and said load carriage first in one direction and then in the opposite direction along said first substantially horizontal axis as said load carriage is rotated from said first angular position to said second angular position.

2. Apparatus according to claim 1 wherein said motive means is operative to rotate said load carriage in a second direction of rotation opposite to said first direction of rotation between said first angular position and a third angular position substantially 90 degrees from said first angular position, and said means for translating said platform and said load carriage is operative to translate said platform and load carriage first in one direction and then in the opposite directin along said first substantially horizontal axis as said load carriage is rotated from said first angular position to said third angular position.

3. Apparatus according to claim 1 wherein said means for translating comprises means for moving a pivot member in substantially a prolate epitrochoidal path relative to said platform as said load carriage is rotated, and a link pivotally connected between said pivot member and said main carriage.

4. Apparatus according to claim 1 wherein said means for translating is arranged to translate said platform along said first axis at a rate relative to rotation of said load carriage during a terminal portion of said rotation to said second angular position such that a corner of a predetermined shape of load carried on said load carriage does not travel appreciably along said first axis during said terminal portion of said rotation.

5. Apparatus according to claim 1 wherein said means for translating comprises a first gear affixed to said platform, a second gear, means for swinging said second gear about 90 degrees of the periphery of said first gear with said second gear meshing with said first gear as said load carriage is rotated, a crank connected to be rotated by said second gear, and a link pivotally interconnecting said crank and said platform.

6. Apparatus according to claim 1 wherein said means for translating comprises a second motive means for translating said platform relative to said main carriage along said first axis.

7. Apparatus according to claim 5 wherein said first gear has twice the radius of said second gear.

8. Apparatus according to claim 5 wherein the length of said crank exceeds the radius of said second gear.

9. Apparatus according to claim 6 having means for sensing rotation of said load carriage to provide control signals, and a position servomechanism including said second motive means responsive to said control signals for translating said platform relative to said main carriage.

10. In load handling apparatus which includes a main carriage elevatable and lowerable along a mast, a platform mounted on said main carriage for reciprocating movement relative to said main carriage along a first horizontal axis, a load carriage mounted on said platform for rotation about a vertical axis, said load carriage including a load support and means for extending and retracting said load support parallel to a second horizontal axis, motive means for rotating said load carriage between a first angular position in which said second horizontal axis coincides with said first horizontal axis and a second angular position substantially 90 degrees from said first angular position, a crank connected to be rotated in an amount directly proportional to rotation of said load carriage, and a link connected between said crank and said main carriage, the improvement which comprises means interconnecting said crank and said load carriage so that rotation of said load carriage through a given angle causes rotation of said crank through an angle greater than said given angle.

11. The apparatus of claim 10 in which said means interconnecting said crank and said load carriage comprises a pair of gears having mutually differing diameters.

12. The apparatus of claim 11 wherein one of said gears has twice the diameter of the other of said gears.

* * * * *